United States Patent [19]

May et al.

[11] Patent Number: 4,947,570

[45] Date of Patent: Aug. 14, 1990

[54] DISPLAY UNIT

[75] Inventors: Proctor May, Mississauga, Canada; Jack Hughes, New York, N.Y.

[73] Assignee: Wesco Promotions, Inc., Toronto, Canada

[21] Appl. No.: 289,988

[22] Filed: Dec. 22, 1988

[51] Int. Cl.[5] ..... G09F 13/00

[52] U.S. Cl. ..... 40/553

[58] Field of Search ..... 40/553, 554, 555, 610, 40/607, 541

[56] References Cited

U.S. PATENT DOCUMENTS

| | | | |
|---|---|---|---|
| 3,974,584 | 8/1976 | Shorette | 40/545 |
| 4,075,775 | 2/1978 | Shorette | 40/553 |
| 4,290,218 | 9/1981 | Drueck, Jr. | 40/553 |
| 4,392,316 | 7/1983 | Thomas | 40/610 |
| 4,528,764 | 7/1985 | Cobb | 40/553 |
| 4,667,829 | 5/1987 | Edmund-White | 40/607 |

*Primary Examiner*—Gene Mancene
*Assistant Examiner*—Michael Lynch
*Attorney, Agent, or Firm*—Bierman and Muserlian

[57] ABSTRACT

A display unit having at least five translucent panels on which messages can be printed, including end panels, side panels and bottom panels. The side panels are adapted to support the bottom panel and the end panels are adapted to support both the side and the end panels are adapted to support both the side and bottom panels. The side panels are further adapted to fit into the support grid of the suspended ceiling over a fluorescent light fixture. Such a display unit can be easily installed on the ceiling of a store, with no tools, in order to display advertisements.

14 Claims, 2 Drawing Sheets

DISPLAY UNIT

BACKGROUND OF THE INVENTION

The present invention relates ,to a display unit and more specifically, to a display unit adapted to fit into the support grip of a suspended ceiling over a fluorescent light fixture. The display unit can be assembled and installed easily and without any tools.

Prior art display units adapted to be attached to the ceiling of stores in order to provide advertising space were either molded in one piece or relied upon clips and/or screws to hold the display together. The latter type required tools to assemble and were therefore, assembled at a central distributing point, such as an advertising agency, and transported to the stores preassembled. Due to the above, these display units were bulky and could not be easily transported to stores in, for example, the trunk of a salesman's car.

Prior art display units did not allow the individual panels thereof to be easily replaced and the message printed thereon could not be changed. Additionally, these display units required screws, clips or some other attaching means to attach them to the ceiling, and if illumination was required, a separate light source and electrical connection was required. The above defects and design prevented salesmen from installing these units themselves Instead, the units had to be shipped to the store in trucks and installed by trained installation personnel.

SUMMARY OF THE INVENTION

The present invention was designed in order to obviate the above described problems. The inventive display unit comprises at least five panels including side panels, end panels, and bottom panels. The end panels have a first set of flanges which support the side and bottom panels. The side panels have a second set of flanges for further supporting the bottom panels, and a third set of flanges adapted to fit into the support grid of a suspended ceiling over a fluorescent light fixture, thereby attaching the display unit to the ceiling.

Holes may be provided in the flanges and in the corresponding areas of the panels which rest thereupon and studs can be inserted through these holes to further secure the panels to one and other and additional reinforcing means can be placed over the flange areas. Such a display unit be shipped in a collapsed condition and easily assembled and installed by a salesman in the store.

In a modification of the invention, the end panels are not provided with flanges. Instead, the bottom panel is supported by the second set of flanges on the side panels. A right angle reinforcing member is provided which overlaps the corners at which the side and end panels meet. The reinforcing member can be secured by screws and the like or may have an inner adhesive surface.

DETAILED DESCRIPTION OF THE INVENTION

Figure 1:
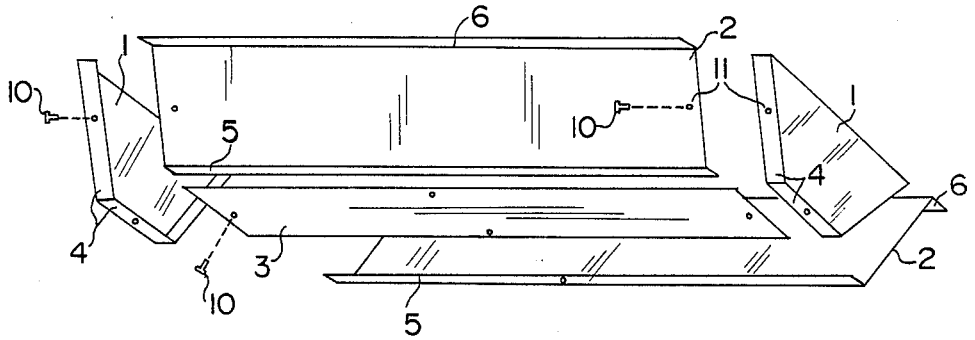
FIG. 1 illustrates the unassembled display unit with the pieces shown in positional relationship to one and other.
Figure 2:
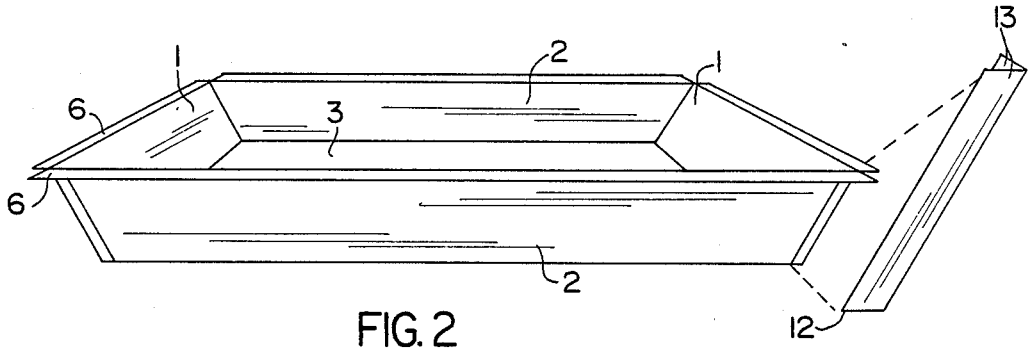
FIG. 2 shows an assembled display unit.
Figure 3:
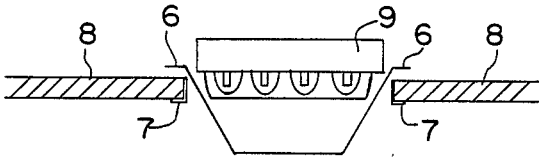
FIG. 3 illustrates the position of the installed unit over a fluorescent light fixture in a ceiling.

The inventive display unit comprises at least five panels including side panels 1, end panels 2, and bottom panels 3. The end panels 2 each have a first flange 4 adapted to support the bottom panel 3 and side panels 1 thereon. The side panels have second flanges 5 for further supporting the bottom panel 3 and third flanges 6 adapted to fit between the grid member 7 of a suspended ceiling 8, thereby attaching the display unit to the ceiling 8.

The display unit is preferably formed of translucent plastic panels and positioned over a fluorescent light fixture 9 suspended in the ceiling 8. Most preferably, the panels are formed of translucent styrene Studs 10 fit through holes 11 formed in the flanges and panels to further secure the panels to each other. Optionally, reinforcing pieces 12 having an adhesive strip 13 on the inside surfaces thereof can be applied to the corners of the display. Advertisements or other such signs can be printed or attached to each of the side 1, end 2, bottom 3 panels. Silk screening or the covering of the panels with a self-adhesive mylar can be used to apply the advertisement. The message panels can also be adapted to hold removable acetates.

Figure 4:
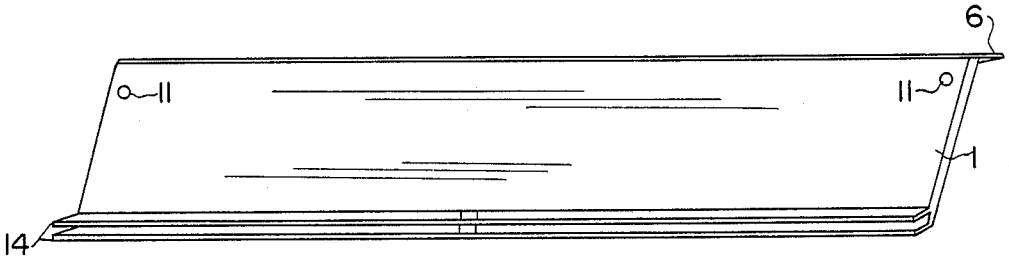
FIG. 4 illustrates a second embodiment of panels wherein two flanges define a channel for better securing the panels to each other.

A preferred embodiment of the invention is illustrated in FIG. 4 wherein each panel has a set of flanges 14 between which other panels are inserted. This set of flanges 14 better secures the panels to each other.

Figure 5:
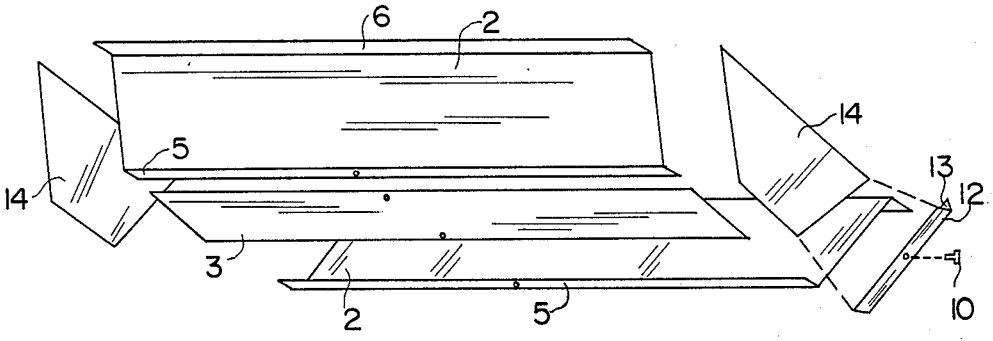
FIG. 5 illustrates another embodiment of the invention wherein a flangeless end panel is secured to the side panels using a right angle reinforcing member.

An additional embodiment of the invention is illustrated in FIG. 5 wherein a flangeless end panel 14 is used. The end panel 14 is secured to the side panels 2 using a right angle reinforcing member which overlaps the corners at which the side panels 2 and end panels 14 meet. The reinforcing member can be attached using attaching means including screws or studs 10 or an inner adhesive surface 13.

The inventive display unit can develop a dramatic in-store display vehicle which will increase brand awareness and visibility, highlight a special seasonal promotion and reinforce brand positioning and is designed for quick and convenient in-store assembly and installation, without the use of any tools. Individual panels, and messages printed thereon can be easily changed and no illuminating means are required as existing light fixtures can be used for this purpose. Side and bottom panels can be easily cut in order to fit any standard ceiling configuration.

It is to be understood that the examples present in the foregoing specification are merely illustrative of this invention and are not intended to limit it in any manner. The scope of the invention is to be determined by the appended claims.

What is claimed is:

1. A display unit adapted to be suspended between grid members of a suspended ceiling, said unit comprising, at least five translucent panels including two side panels, tow end panels, and a bottom panel, said end panels having first flanges supporting said side and bottom panels, said side panels having second flanges for supporting said bottom panel and third flanges adapted to fit between said grid members and support said unit wherein, at least one of said panels displays a message.

2. The display unit of claim 1 wherein the said panels are constructed of a translucent material.

3. The display unit of claim 2 wherein said translucent material is a plastic.

4. The display unit of claim 3 wherein said plastic is styrene.

5. The display unit of claim 2 wherein said display unit is adapted to fit into said suspended ceiling over a fluorescent light fixture.

6. The display unit of claim 1 wherein a message is printed on at least one of said panels.

7. The display unit of claim 1 wherein attaching means passes through said first and second flanges to secure the panels supported thereby.

8. The display unit of claim 1 comprising five panels including two side panels, two end panels, and a bottom panel.

9. The display unit of claim 1 wherein said flanges are reinforced with reforcing means, said reinforcing means being adapted to overlap corners of said flange and the panels being joined.

10. The display unit of claim 9 wherein said reinforcing means comprises adhesive strips whereby said reinforcing means can be adhered to saaid panels.

11. The display unit of claim 1 wherein at least one of said flanges is a double flange forming a channel therebetween into which a supported panel can be inserted.

12. A display unit adapted to be suspended between grid members of a suspended ceiling, said unit comprising at least five translucent panels including two side panels, two end panels and a bottom panel, said side panels having a flanges for supporting said bottom panel and additional flanges adapted to fit between said grid members and support said unit, said end panels being secured to said side panels by reinforcing members which overlap corners of said panels being secured thereby, said reinforcing members being attached to said side panels and end panels by attaching means; wherein a message is displayed on at least one of said panels.

13. The unit of claim 12 wherein said attaching means are screws or studs.

14. The unit of claim 12 wherein an inner surface of said reinforcing means is an adhesive surface, said adhesive acting as said attaching means.

* * * * *